US007322727B2

(12) United States Patent
Lampen et al.

(10) Patent No.: US 7,322,727 B2
(45) Date of Patent: Jan. 29, 2008

(54) ILLUMINATION DEVICE

(75) Inventors: Martin Lampen, Tuebingen (DE); Hermann Kellermann, Reutlingen (DE)

(73) Assignee: Automotive Lighting Reutlinger GmbH (DE)

( * ) Notice: Subject to any disclaimer, the term of this patent is extended or adjusted under 35 U.S.C. 154(b) by 0 days.

(21) Appl. No.: 11/486,850

(22) Filed: Jul. 13, 2006

(65) Prior Publication Data

US 2007/0070643 A1 Mar. 29, 2007

(30) Foreign Application Priority Data

Sep. 24, 2005 (DE) ..... 10 2005 045 685

(51) Int. Cl.
*F21V 7/00* (2006.01)

(52) U.S. Cl. ..... 362/517; 362/516; 362/518

(58) Field of Classification Search ..... 362/517, 362/518, 516

See application file for complete search history.

(56) References Cited

U.S. PATENT DOCUMENTS 6,829,412 B2 * 12/2004 Li ..... 385/31
6,921,188 B2 * 7/2005 Taniuchi ..... 362/517

FOREIGN PATENT DOCUMENTS

DE 10 2005 045 685 3/2007

* cited by examiner

*Primary Examiner*—Sandra O'Shea
*Assistant Examiner*—James W Cranson, Jr.
(74) *Attorney, Agent, or Firm*—Central Coast Patent Agency Inc.

(57) ABSTRACT

The invention relates to an illumination comprised of an illumination source of electromagnetic radiation and a multi-part reflector (10) to route and focus the electromagnetic illumination, whereby the function of the separation (Y) from the angle (β) across at least partial areas of the reflector (10) is not a constant function.

6 Claims, 5 Drawing Sheets

ILLUMINATION DEVICE

Figure 1:
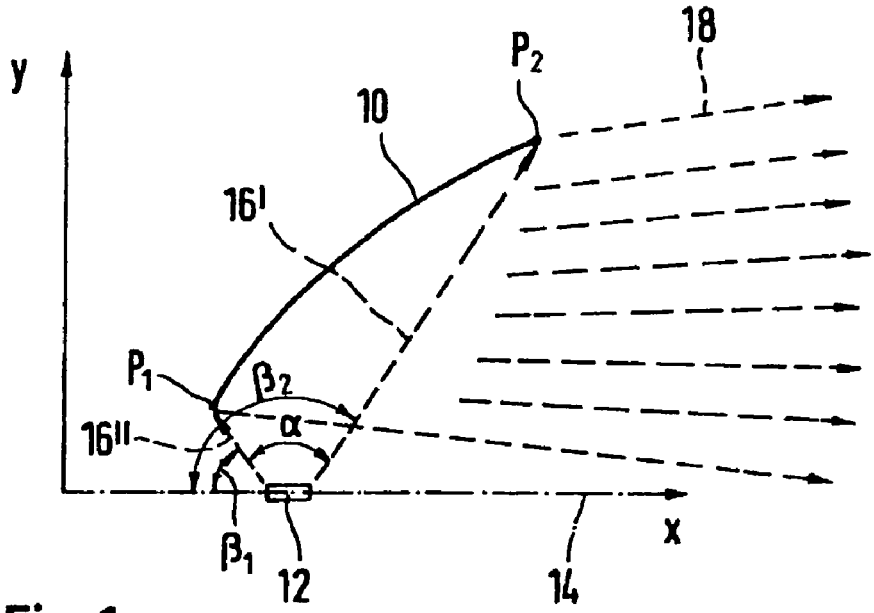

The present application claims priority to a German patent application serial number 10 2005 045 685.5 entitled "Illumination Device", which was filed on Sep. 24, 2005, which is incorporated herein in its entirety, at least by reference.

DESCRIPTION

The invention relates to an illumination device comprised of an illumination source of electromagnetic radiation and a multi-part reflector to route and focus the electromagnetic illumination.

It is known, for example, to use such devices in headlights whereby the illumination source possesses a light source, particularly an incandescent lamp, but possibly an arc lamp. A reflector is provided that may alternatively be of multiple parts in order to route and focus the illumination to the area in front of an automobile in which such a headlight is installed. For this, the reflector must reflect the greatest possible amount of the light from the light source in the desired direction. For manufacturing reasons, generally simple basic bodies such as parabolloids, ellipsoids, or combinations thereof, or minor deviations from these shapes, are used.

The particular problem in the automotive industry is the fact that there are severe spatial limitations to headlight mounting, particularly because of progressive stylistic design of automobile bodies. Technology can therefore react to this only be reducing the reflector size, which involves technical shortcomings. If, however, reflector size must be reduced both in depth as well as in height in an automobile, there will be light loss because only a small angular volume of light emitted from the light source strikes the reflector. In order to maintain this 'enclosure' area, the reflector must be reduced in size, which leads to sacrifices to maximum light intensity of the distributed light. Also, system tolerance sensitivity is thereby increased.

Moreover, it is also known to provide reflectors with bends or steps in the reflector geometry, i.e., multi-part reflectors. The individual reflector elements for this are mounted to be similar to a single reflector.

It is the task of the invention to provide an illumination unit with a reflector to route and focus the electromagnetic illumination that offers the advantage of reducing mounting space while maximizing light intensity.

The invention solves this task by means of an illumination unit in which the function of the separation Y from angle $\beta$ is not a constant function for at least partial areas of the reflector. The angle $\beta$ thereby extends between a reflector point P and the optical axis X with its vertex in the area of the light source. Y is the separation between the point P and the optical axis X.

This invention allows keeping the 'enclosure' angle of the light source with respect to a fixed, constant-function reflector, as well as keeping the so-called projected light exit area in the direction of the X-axis that represents a standard for maximum intensity of light distribution. The spatial requirement for the use of several reflector parts, particularly if shell-shaped, can be significantly reduced. Moreover, the invention possesses the advantage that no shadow images result from the reflectors during the use of point sources, or sources that are approximately point-shaped, and elongated light sources suffer limited losses that technically play only a secondary role. It is possible with the invention to take advantage of the light volume from the light source at a higher degree of efficiency in order simultaneously to achieve maximum intensity concentrations in light emission from the headlight, or from a system emitting another electromagnetic illumination. The projected light or illumination exit area may be completely used.

Moreover, separation of the reflective surfaces improves the configuration options of the technical assembly, for example during control of the magnitude of the light-source images or during the achievable exit angles to the optical axis for the light beams.

Based on the invention, it may be provided that the illumination source emits visible radiation, i.e., light. Alternatively, radiation in the ultra-violet or infrared ranges, or in other ranges, may be emitted. Combinations of various emission types are also possible.

Finally, the invention relates to an illumination device, particularly an automobile headlight, with an illumination device of the above-mentioned type. The illumination device may possess illumination devices operating both in the visible and in the invisible ranges (IR of UV).

The invention is not limited to technical lighting applications. In particular, other frequency ranges of electromagnetic illumination may also be focused and diverted, e.g., for transmission and reception devices. To the extent that the device is being used within the scope of a technical illumination device as is used in automobiles, it may be used either in a projection headlight system or a headlight system without lenses.

Figure 2:
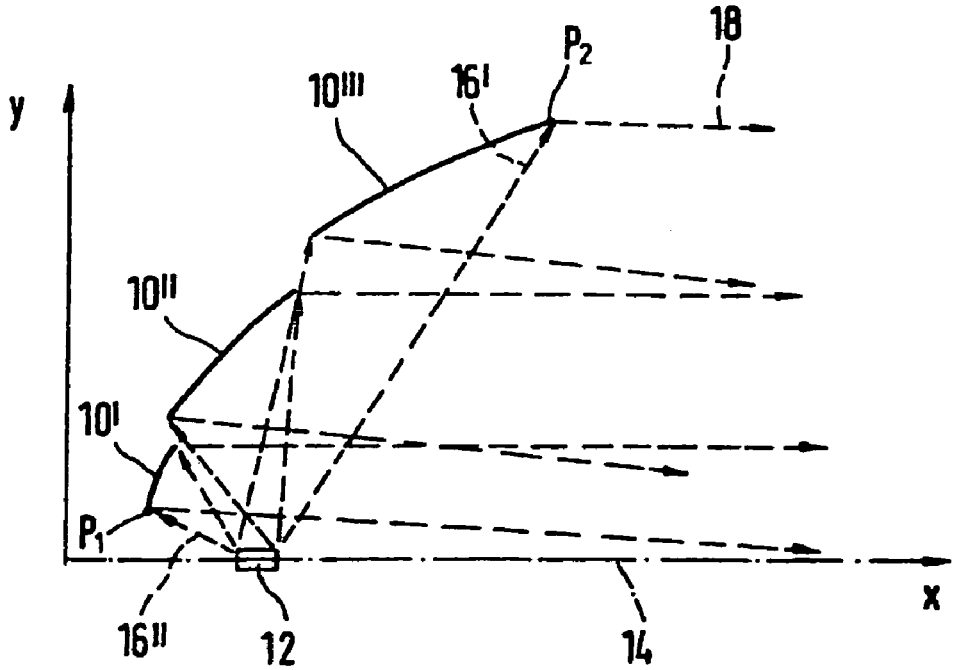
Figure 3:
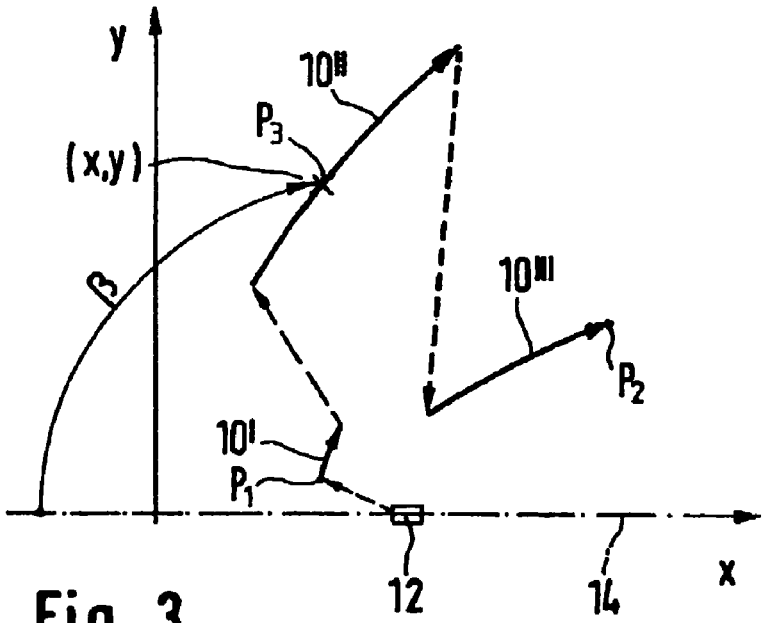

Further advantages and properties of the invention may be taken from the other application documents. The invention will be described in the following in greater detail using Figures, which show:

FIGS. 1 & 2 reflector configurations per the State of the Art;

FIG. 3 schematic view of the geometric elements based on the invention;

FIGS. 4-7 comparative views of configurations based on the invention with State-of-the-Art reflectors.

FIG. 1 shows a reflector as known in headlight technology as the State of the Art, which here is designated with reference index 10. The reflector 10 of such a headlight of such an illumination device acts together with a light source, whereby the reflector 10 from FIG. 1 is shown as an upper half-cutaway and the optical axis is designated with reference index 14. The light emitted from the light source 12 toward the reflector 10 is shown by means of its two limiting beams designated with 16 and 16'. These two beams 16 and 16' define an angle $\alpha$ that represents the so-called 'enclosure' of the light source 12. The light reflected from the reflector 10 is radiated along a light-exit direction, symbolized here by the dashed arrows 18. The reflector depth is determined along the X-axis 14 that corresponds to the optical axis 14, while the second axis, designated here with Y, determines the separation from the optical axis 14.

FIG. 2 shows a configuration also known to the State of the Art whereby parts labeled for FIG. 1 receive the same reference indices.

The reflector 10 from FIG. 1 is shown as a one-piece reflector 10 that represents a constant function with respect to the angle $\beta$ between a point P1 on the reflector and a point P2 on the reflector, and whereby this function remains firmly constant, i.e., the Y values for the reflector 10 rise constantly within the interval between the two points P1 and P2, i.e., between the smallest least angle $\beta$ and the greatest angle $\beta$, as shown using $\beta_1$ and $\beta_2$ in FIG. 1.

If one considers FIG. 2 in contrast, then the reflector 10 consists here of three parts 10' through 10''', and the progression of the reflector is not a constant function, but rather possesses not only steps or bends, but also gaps. The function of the separation from the optical axis 14 across the progression of the angle β from beam 16' to beam 16''' remains an essentially constantly increasing function.

An increase of installation space or a reduction in depth cannot be achieved using such a multi-part reflector configuration.

In general, it must be determined (FIG. 3) that the separation form the optical axis 14, which may be read off axis Y, may be represented as a function of β.

One then obtains for conventional reflectors a constant function, i.e., if β increases, Y also increases. Known step reflectors also do not break this dependency. To the contrary, reflectors based on the invention possess such a constant behavior only within individual reflector parts. It is characteristic that so-called 'coordinate jumps' (non-constant points) exist between the individual reflector parts 10' and 10'''. Moreover, the reflector based on the invention possesses the advantage with respect to conventional stepped reflectors that they may be configured so that all Y values are illuminated by the light source. In conventional stepped reflectors, a portion of the Y values are not illuminated because of the steps provided, in contrast to which, as may be taken from FIG. 3, this may be avoided using the configuration based on the invention. This allows better use of the achievable light intensity of the system, or for an observer of, for example, a radiation device based on the invention, e.g., in the form of a headlight.

Figure 4:
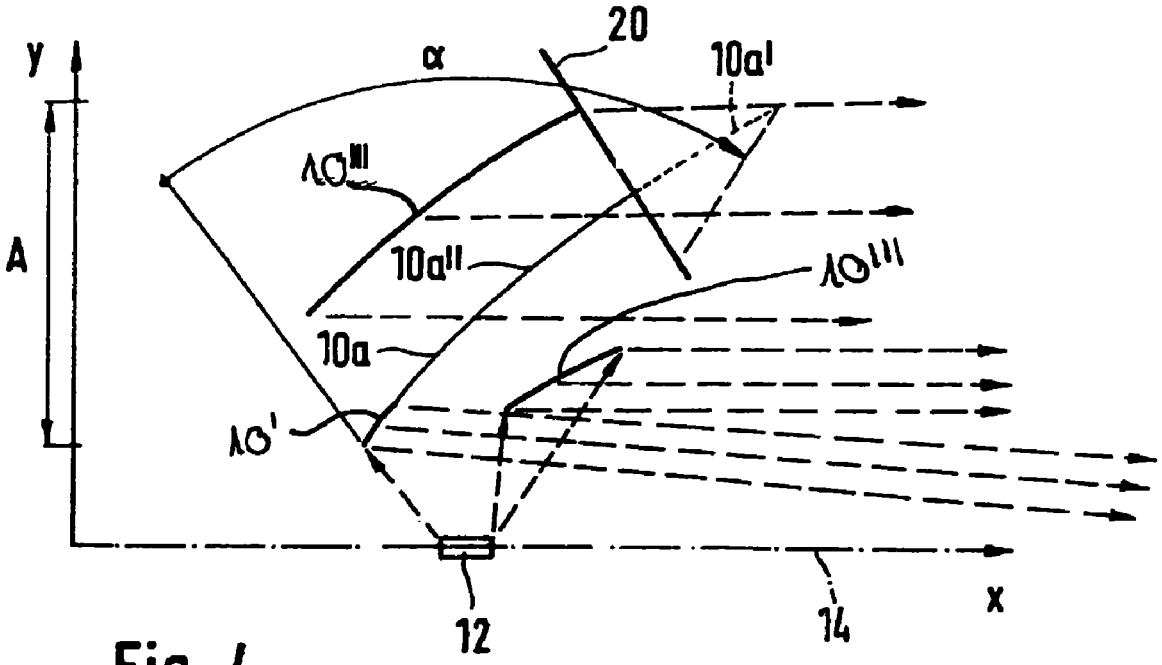

FIG. 3 shows the angle β at a random point P3, as well as the points P2 and P1. The reflector progression with respect to the value Y over the angle β is thus constantly increasing within the reflector parts 10', 10''. The light source 12 may be seen idealistically as a point light source. The functions of the three individual reflector parts are also constantly increasing. However, the progression of the reflector 10 with respect to the X values at the transition from reflector part 10'' to reflector part 10''' includes a so-called 'jump,' so that Y experiences a jump-like reduction as β increases, whereby the formerly constant increase in Y stops. Thus, FIG. 3 also shows a cutaway view through a reflector 10 based on the invention. The provision of a three-part reflector 10 with parts 10' through 10''' who are positioned offset with respect to one another along the X axis allows the enclosure to be completely used, as FIG. 4 shows. Thus, FIG. 4 shows a reflector designated by 10*a* for better clarification illustrating the State of the Art.

FIG. 4, which shows a functional diagram, shows a limitation to mounting space using the line 20, so that the part 10*a'* of the original reflector is omitted. Such a curtailed reflector, of which only the area 10*a''* may be used, would, however, deliver a clearly reduced enclosure angle α. Moreover, the projected surface designated along the Y axis with A for the overall reflector 10*a* would be reduced. FIG. 4 makes clear that division of the reflector into three individual reflectors 10 through 10''' allows compliance with a limited mounting space while maintaining the enclosure designated by the angle α. Moreover, the projected area is not reduced. Light intensity and light volume of the headlight are maintained, for example, for an automobile headlight illuminating the road ahead. A reflector configuration based on the invention therefore possesses clear advantages to reflector depth in limited mounting conditions.

Figure 5:
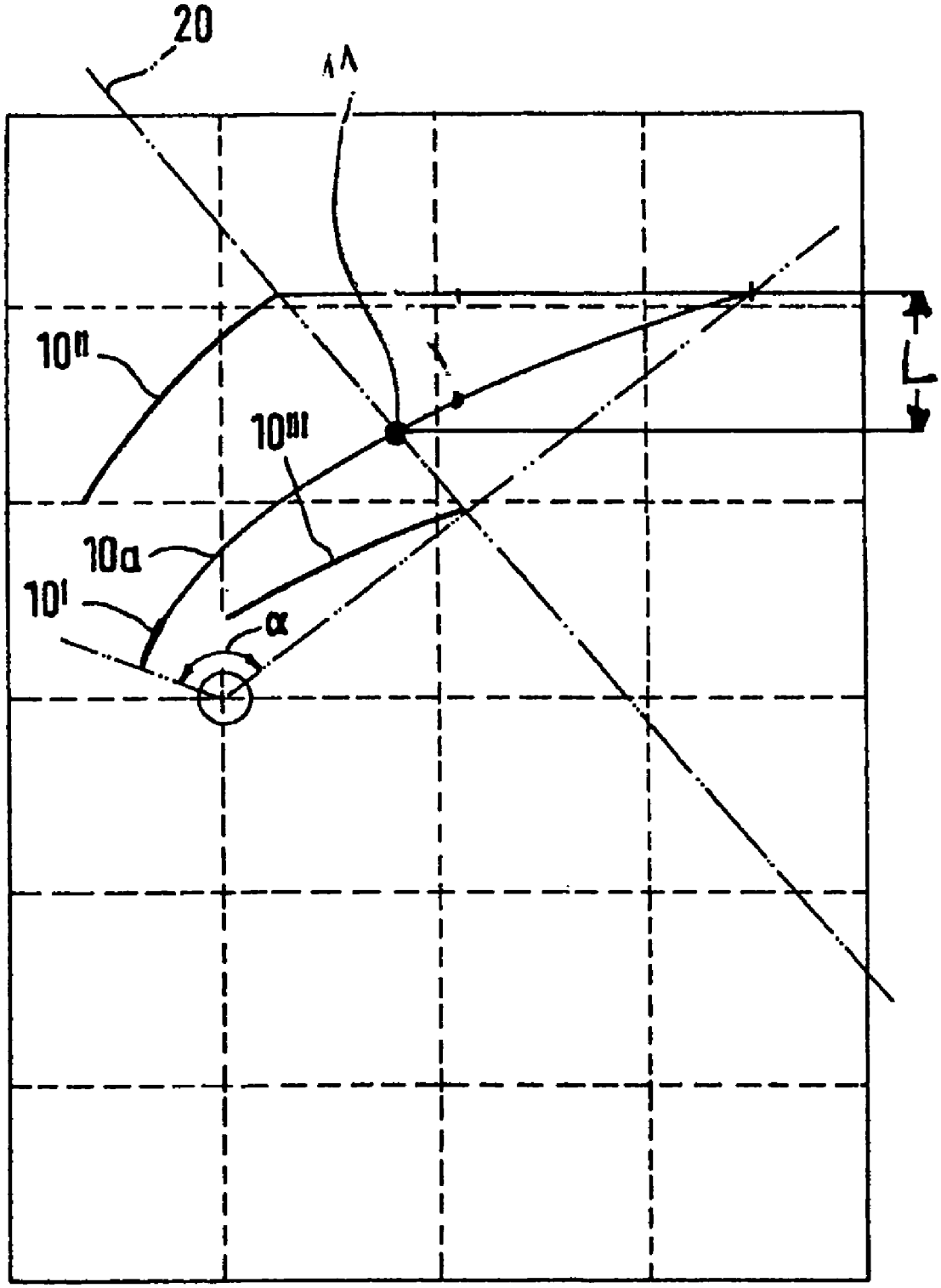

FIG. 5 shows another embodiment example of the invention. Mounting space limitations often lead to obliquely-cut reflectors, as symbolized by the line 20. The outermost realizable conventional reflector point is designated here with 11. Such reflectors, however, possess difficulties in achieving the desired projected light exit surface or enclosure. In particular, the surfaces of the reflector are too short on one side of the optical axis, which leads to shortcomings regarding technical and/or stylistic issues. Such shortcomings may be avoided in reflectors based on the invention that are of multiple parts. The reflector part 10'' may recreate the light exit surface cut away. In the Figure, the area of the recreated light exit surface is designated with L.

Figure 6:
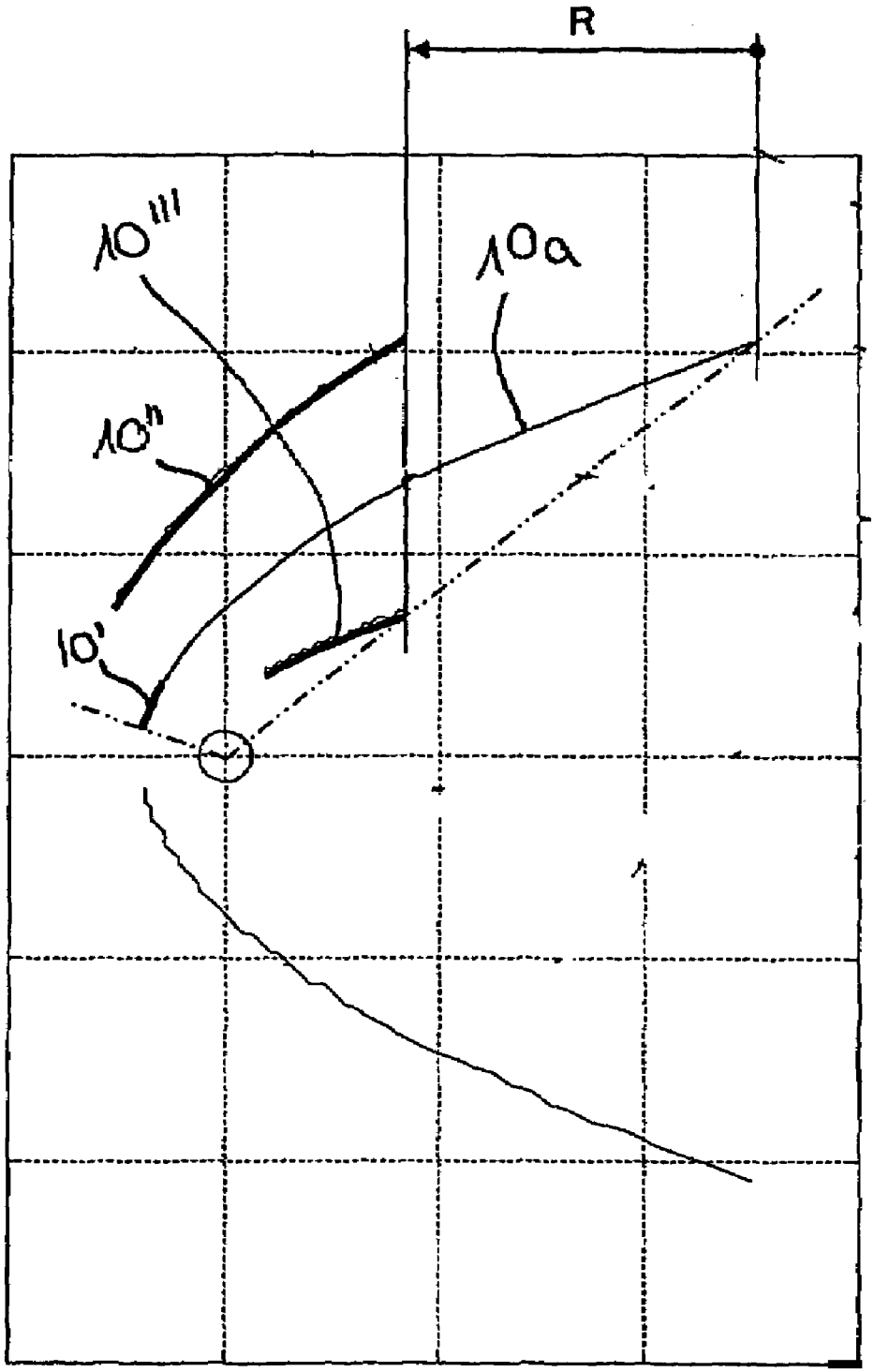

FIG. 6 shows a compact high-beam headlight, whereby here an often-requested mounting-space reduction R along the direction of travel is specified. In comparison with the conventional parabolic headlight with a specified focal distance designated with 10*a*, a non-constant reflector whose three parts are designated with 10', 10'', and 10''' is shown. It may be determined that, in spite of multiple reflector parts and focused beam, no shadows arise. The projected light surface A (see FIG. 4) is completely used, as is the enclosure angle α of the light source. The focal lengths of the three reflector parts are all different.

The configuration based on the invention allows particularly the shape of the reflectors 10 to be adapted to specified values without suffering losses to the usability of the reflector 10.

Figure 7:
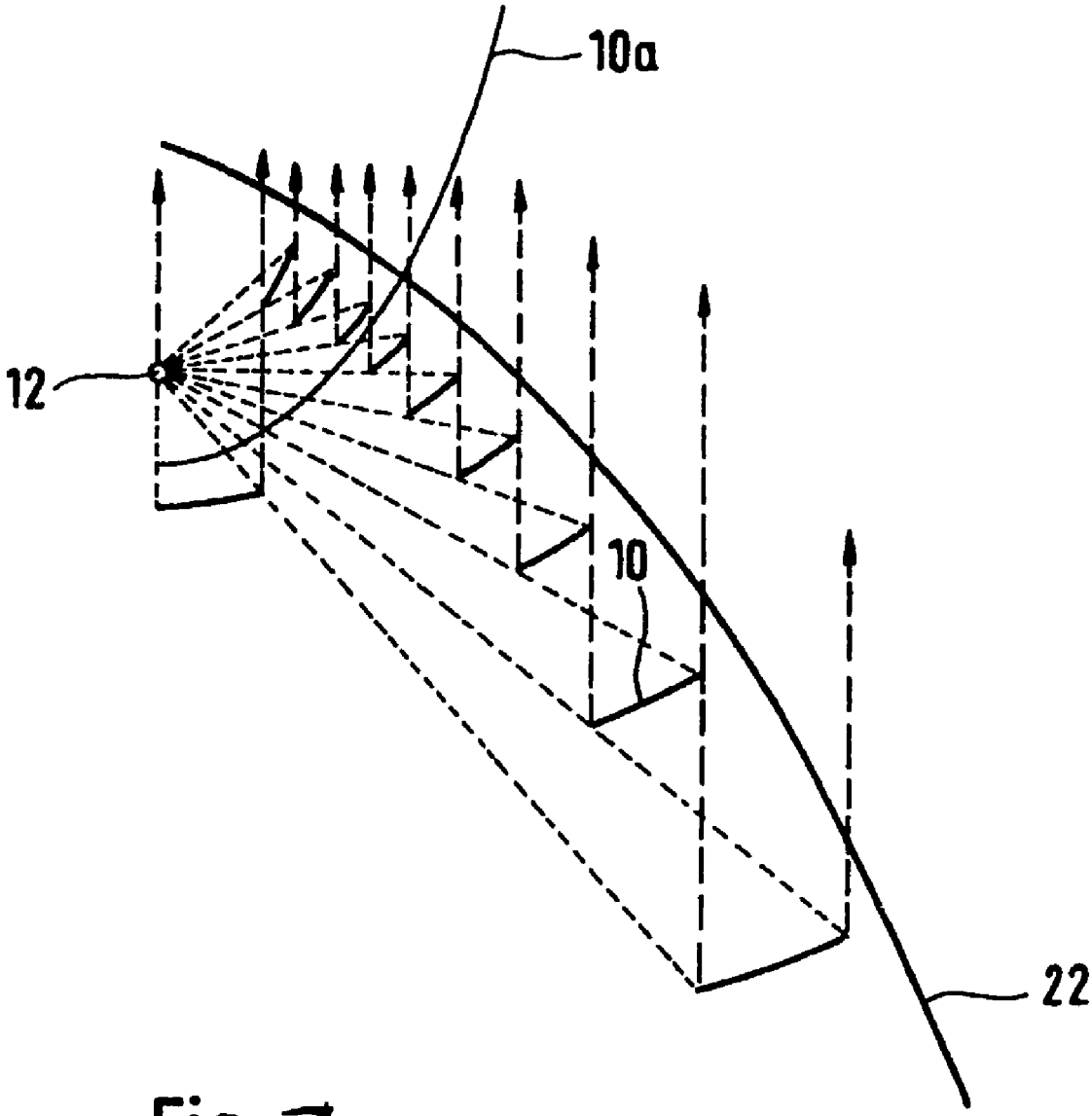

FIG. 7 shows an embodiment in which the outer shape of a headlight is specified. This is designated with reference index 22. A conventional parabolic shape of a reflector 10 is designated with the reference index 10*a*. If individual segments are provided per the invention, then the shape of the reflector may be adapted to the desired shape of the headlight, and simultaneously the technical parameters may be improved. In this manner, an intense light beam through the large enclosure of the light source 12 may be achieved with maximum illumination intensity of the irradiated light distribution through a large projected light exit surface. Esthetically empty surfaces are avoided, and the functional impression of a large signal image may be achieved across the entire outer surface.

The invention claimed is:

1. A radiation device comprising;

a source (12) of radiation and a reflector (10) having a plurality of reflecting parts, the reflecting parts having a common axis (X) of symmetry and each providing reflected light substantially in the direction of the axis of symmetry away from points of reflection;

characterized in that any point P on any part of the multi-part reflector has a separation dimension Y, orthogonal to axis X, that may be expressed as a function of an angle β, such that Y=f (β), where β is an angle with apex at the source of illumination, a first (base) leg along the axis of symmetry opposite the direction of reflected illumination, and a second leg from the apex to the point P, such that the function for Y in terms of β is discontinuous for at least one region of β, and decreases in at least one region of β with increase in β.

2. The radiation device as in claim 1, characterized in that the radiation source (12) emits visible light.

3. The radiation device as in claim 2, characterized in that the reflector (10) consists of three or more reflector parts (10'- 10''').

4. The radiation device as in claim 1, implemented as an automobile headlight.

5. The radiation device as in claim 1 wherein the reflector parts are arranged such that all light reflected is reflected once only.

6. The radiation device as in claim 1 wherein no reflector part blocks reflected light from any other reflector part.

* * * * *

UNITED STATES PATENT AND TRADEMARK OFFICE

CERTIFICATE OF CORRECTION

PATENT NO. : 7,322,727 B2
APPLICATION NO. : 11/486850
DATED : January 29, 2008
INVENTOR(S) : Martin Lampen and Hermann Kellermann It is certified that error appears in the above-identified patent and that said Letters Patent is hereby corrected as shown below:

Title Page; item (73);

Assignee now reads: Automotive Lighting Reutlinger GmbH

Assignee should read: Automotive Lighting Reutlingen GmbH

Signed and Sealed this

Twenty-second Day of September, 2009

David J. Kappos

David J. Kappos
*Director of the United States Patent and Trademark Office*